US010334895B1

(12) United States Patent
Levine

(10) Patent No.: US 10,334,895 B1
(45) Date of Patent: Jul. 2, 2019

(54) MEDICAL GOWN WITH EASY TIE STRAP

(71) Applicant: Ian Levine, Cote St Luc (CA)

(72) Inventor: Ian Levine, Cote St Luc (CA)

( * ) Notice: Subject to any disclaimer, the term of this patent is extended or adjusted under 35 U.S.C. 154(b) by 0 days.

(21) Appl. No.: 16/161,915

(22) Filed: Oct. 16, 2018

(51) Int. Cl.
*A41D 13/12* (2006.01)

(52) U.S. Cl.
CPC ..... *A41D 13/1209* (2013.01); *A41D 13/1245* (2013.01); *A41D 13/129* (2013.01)

(58) Field of Classification Search
CPC ..... A41D 13/1236; A41D 13/1209
See application file for complete search history.

(56) References Cited

U.S. PATENT DOCUMENTS 4,384,370 A 5/1983 Singer
4,434,511 A * 3/1984 Weiser ..... A41D 13/129 2/114
4,853,977 A * 8/1989 Foreman ..... A41D 13/1263 2/114
5,361,414 A 11/1994 Smith
5,414,867 A 5/1995 Bowling et al.
7,971,274 B2 * 7/2011 Graneto, III ..... A41D 13/1209 2/114
8,332,965 B1 12/2012 Ryer
8,826,466 B1 * 9/2014 Michaelis ..... A41D 15/002 2/69
8,990,966 B2 3/2015 Von Furstenberg et al.
9,089,174 B1 * 7/2015 Michaelis ..... A41D 13/0015
10,064,440 B2 9/2018 Levine
2001/0034891 A1 * 11/2001 Matsushita ..... A41D 13/1209 2/141.1
2010/0319102 A1 12/2010 Kemper
2011/0107494 A1 5/2011 Haines
2014/0237699 A1 * 8/2014 Michaelis ..... A41D 15/002 2/69
2017/0079344 A1 3/2017 Nakajima et al.
2018/0325195 A1 * 11/2018 Emoff ..... A41D 27/24

FOREIGN PATENT DOCUMENTS

CA 2134489 C 4/1996

* cited by examiner

*Primary Examiner* — Tajash D Patel
(74) *Attorney, Agent, or Firm* — McKee, Voorhees & Sease, PLC

(57) ABSTRACT

A gown is provided for medical and other uses which allows the person wearing the gown or an assistant to quickly and easily tie the straps to close the open gap in the back of the gown. The gown includes an elongated first strap having a first end fixed to a back edge of the gown, and then extending upwardly over the shoulder, with a free end hanging in front of the gown. The elongated strap is releasably and temporarily secured near the shoulder of the gown. The person wearing the gown or the assistant can grasp the loose end of the strap and pull, so as to release the strap from the attachment mechanism, and then pull the strap upwardly to pass around the back of the person's neck and downwardly along the opposite side, and then tying to a second strap at a location in front of their body. The straps eliminate the need to reach behind the person's back to tie the gown.

16 Claims, 3 Drawing Sheets

MEDICAL GOWN WITH EASY TIE STRAP

FIELD OF THE INVENTION

The invention is directed toward a gown, such as a medical gown, open in the back, and having a strap for easily tying the gown so as to close the back opening, without the wearer reaching behind his/her back. The gown allows use of an ergonomic motion that causes no stretching, strains or other potential medical issues and allows users portly/large/obese or with neck, back and shoulder problems/injuries to properly close the waist tie without the aid of another person.

BACKGROUND OF THE INVENTION

Gowns, such as medical gowns, are well-known and have long been used to provide personal protection for the wearer, including patients, medical staff, health-care workers, hospital visitors, and others. A common gown design includes a closed front and an open back which allows the user or wearer to place their arms through arm holes or sleeves, and then tying straps on the back of the gown to close the open back. Some gowns also utilize straps on the top back of the gown to tie behind the user's neck, or alternatively, a hook and loop closure. Some gowns utilize waist ties on the back or sides of the gown which can be wrapped to the front or side of the gown for tying. All of these prior art gown designs utilizing the waist tie straps require manipulation by the person wearing the gown to reach behind their back to grasp the waist tie strap, and then tie the straps for closure of the back of the gown and securement of the gown. These manipulations are time-consuming and can be difficult or painful, particularly for persons having back, neck, shoulder injuries or issues. Obese people also may have trouble reaching behind their back to grasp a conventional tie strap. In some instances, the help of a colleague is needed who can pass the waist tie from behind the patient's back to the front to tie the gown closed, which takes additional time, and removes the colleague from other work or care for another person or patient.

Therefore, there is a need for a quick and simple gown design that allows the patient or healthcare professional or worker to put on their own gown, without assistance of another person and without reaching behind their back.

Therefore, a primary objective of the present invention is the provision of a gown having a waist tie which can be easily grasped by the person wearing the gown and manipulated to tie the gown closed, without reaching behind their back.

Another objective of the present invention is the provision of a medical gown having a pair of tie straps which can be easily reached by the wearer for tying the gown on the front or side.

A further objective of the present invention the provision of a gown having a waist tie strap which is temporarily and releasably secured near a shoulder portion of the gown so as to extend from the back edge upwardly over the shoulder and then downwardly for easy grasping by the wearer from the front of the waist or the chest.

Still another objective of the present invention is the provision of a gown having an elongated waist tie strap which extends upwardly from a back edge of the gown, over the wearer's shoulder, and downwardly along the front of the gown for gripping by the person wearing the gown or an assistant.

Yet another objective of the present invention is the provision of an open-back medical gown having a waist tie strap which can be grasped on the front of the gown and pulled above the wearer's head, then across and downwardly for tying on the front of the gown, without the wearer reaching behind their back.

Another objective of the present invention is the provision of an open-back medical gown which can be tied quickly and easily on the front or side to close the open back, without reaching behind the back.

A further objective of the present invention is a provision of a quick tie medical gown which is easy and cost effective to manufacture, durable, safe, and protective in use.

These and other objectives become apparent from the following description of the invention.

SUMMARY OF THE INVENTION

The gown of the present invention may be used for medical or other purposes. The gown includes a closed front and an open back, with sleeves or arm holes, and a neck opening. The back of the gown includes a vertical opening to allow the person to extend their arms through the arm holes and neck into the neck opening. An elongated tie strap has a first end secured to one edge of the back opening adjacent to the waist. The strap extends upwardly over the wearer's shoulder and is temporarily attached to a shoulder portion of the gown, with the free or loose end of the strap hanging downwardly in front of the person at approximately waist to chest level. The free end of the strap can be easily grasped by the person wearing the gown, or by an assistant standing in front of the gown wearer, without reaching behind the person. The free end of the strap is then pulled up so as to release the strap from the shoulder attachment. Then, the strap is pulled over the top of the person's head and neck, and then downwardly so as to wrapped around the person's torso. A second, shorter strap has a first-end fixed to a side or front portion of the gown adjacent the waist and can be grasped by the person's other hand. The two straps are wrapped in opposite directions and tied in front of the person, thereby closing the open back and securing the gown on the person's torso.

DETAILED DESCRIPTION OF THE PREFERRED EMBODIMENTS

Figure 2:
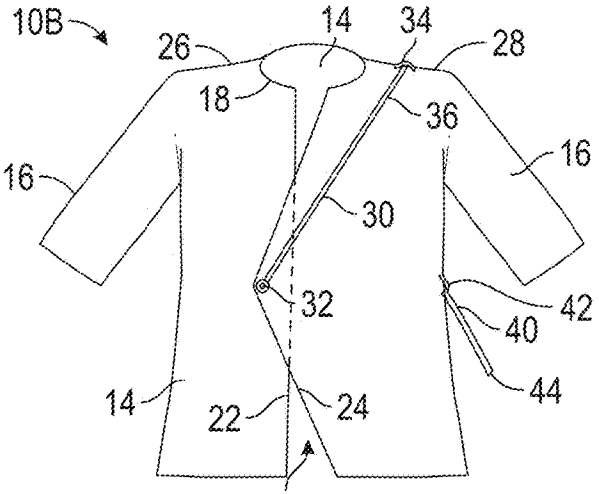
FIG. 2 is a rear view of an alternative gown having a triangular back portion, with an open neck closure or over-the-head design, according to the present invention.
Figure 1:
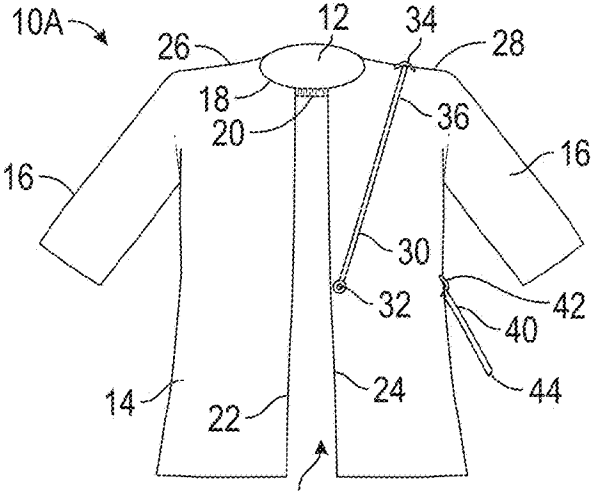
FIG. 1 is a rear view of the first embodiment of the gown of the present invention wherein the gown has a full back design with an open neck closure or over-the-head design.
Figure 3:
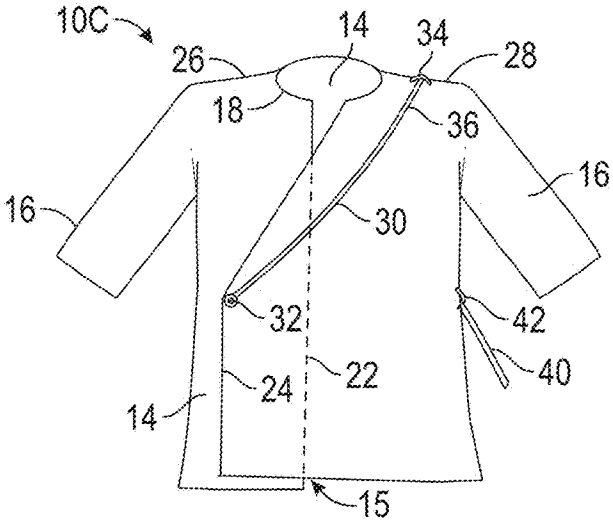
FIG. 3 is a back view of a third embodiment of a gown design, with an open neck closure or over-the-head design, according to the present invention.
Figure 5:
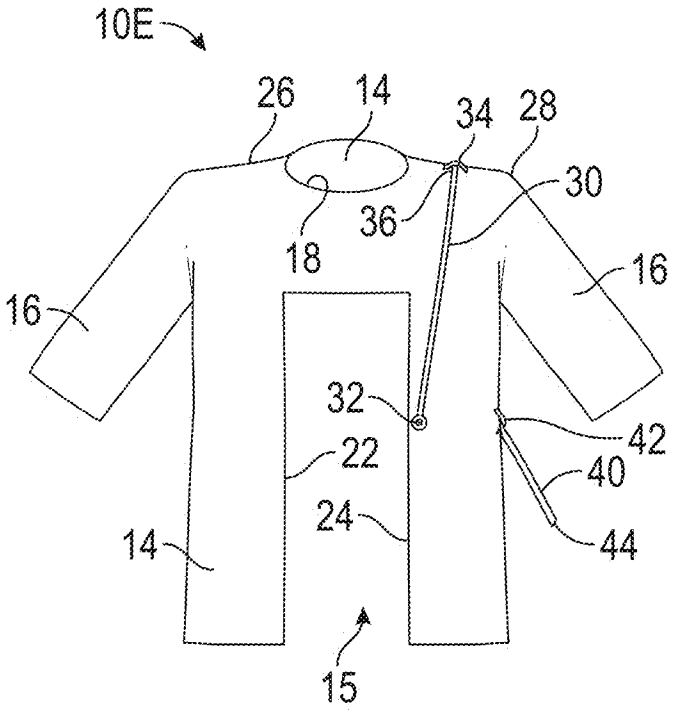
FIG. 5 is a back view of the fifth gown embodiment having a half open back design, according to the present invention.
Figure 4:
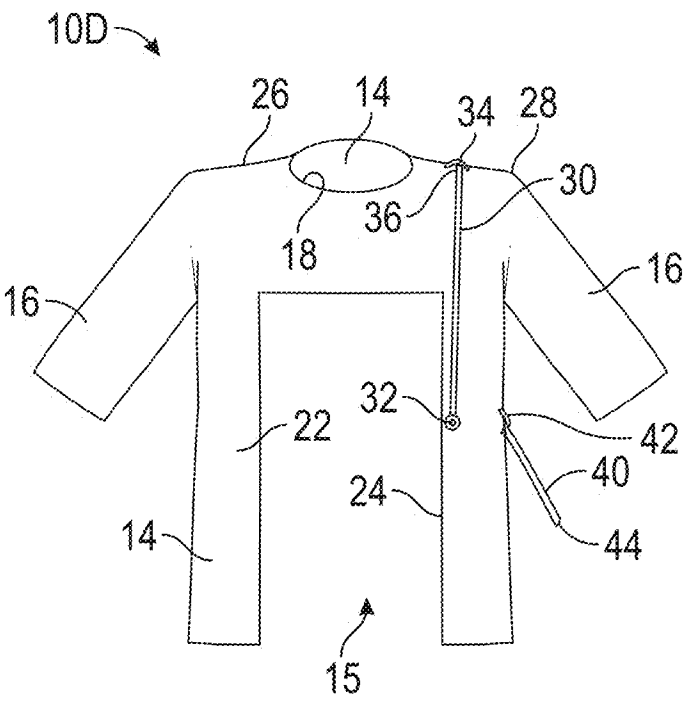
FIG. 4 is a back view of a fourth embodiment of a gown design having a full open back, according the present invention.
Figure 7:
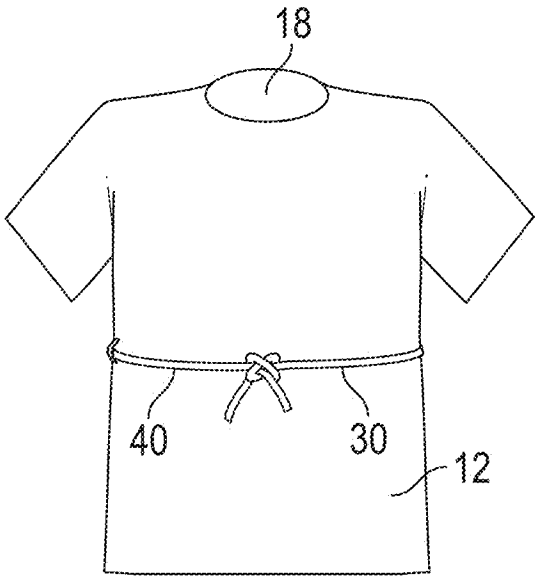
FIG. 7 is a front view similar to FIG. 6 showing the straps tied together.

The gown embodiments shown in FIGS. 1-5 are identified by reference numerals 10A, 10B, 10C, 10D, and 10E, respectively. The gowns all have the same basic construction, including a front portion 12 and a back portion 14 with an opening 15. The gowns 10A-E may have full or short sleeves 16, or may be sleeveless, but all have arm holes through which a person's arms extend when the gown is worn. The front and back portions 12, 14 define a neck opening 18 which may include ties straps (not shown) to tie the top of the gown behind the person's neck, or alternatively, an elastic band 20, as shown in FIG. 1, or a section of material as shown in FIGS. 4 and 5, to allow the gown to be placed over the wearer's head. The back portion of each gown 10A-E has opposite left hand and right hand edges 22, 24 defining the back opening 15. The open back allows the person to slip the gown on. Each of the gowns 10A-E also have left and right shoulder portions 26, 28. The gown 10A-E preferably extends continuously from one back edge 22, 24, laterally around to the front, and then laterally around to the other back edge 22, 24, so as to substantially cover the wearer's torso with the front portion 12, the back portion 14, and opposite side portions between the front and back portions.

The above construction of the gowns 10A-E is conventional and does not constitute a part of the present invention.

Figure 6:
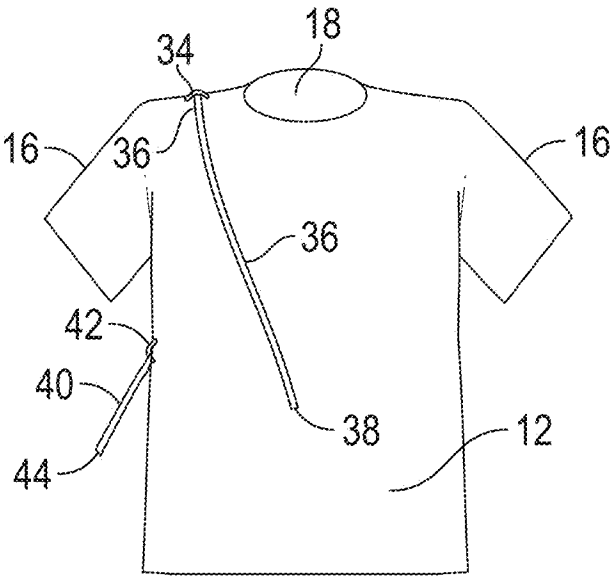
FIG. 6 is a front view of any of the gowns shown in FIGS. 1-5, with a pair of tie straps for closing the back opening of the gown.

The present invention is directed toward the waist tie straps which allow the person to close the back opening 15 of the gown. More particularly, a first elongated strap 30 has a first end 32 fixed to the back portion 14 of the gown adjacent one of the right or left edges 22, 24. While the drawings show the first end 32 of the first strap 30 to be fixed to the right edge of the gown, it is understood that the strap 30 can have its first end 32 fixed to the left edge of the gown, with mirror-image use. The strap 30 initially extends upwardly over one of the shoulder portions 26, 28 on the same left or right side as the edge 22, 24 to which the first end 32 is fixed. The strap 30 includes a fastener 34 temporarily and releasably holding or fastening a mid-portion of the strap 30 to the shoulder portion 26, 28 of the gown on the same side as the fixed end 32 of the strap 30. Alternatively, the fastener 34 may be on the shoulder portion 26 or 28 of the gown. For example, the fastener 34 may be one half of a hook and loop fastener (Velcro), with the other half being on the strap 30. Alternatively, the fastener 34 may be a clip, a snap, adhesive, or other means to releasably attached the strap 30 before the gown is put on. A free or loose end 38 of the strap 30 extends over the person's shoulder and downwardly to a position in front of the person and adjacent his/her waist, as seen in FIG. 6.

A second, shorter strap 40 is attached to the gown, preferably at approximately waist height and beneath the sleeves 16 on the same side to which the first end 32 of the long strap 30 is fixed, as shown in the drawings. The free or loose end 44 of the second strap 40 can be easily reached by the person's second hand.

In use, the gowns 10A-E can be placed on a person, from the front, by opening the back portion 14 and sliding the arms through the sleeves 16 or arm holes of a sleeveless gown. The person wearing the gown can then grasp the loose end 38 of the first strap 30 with one hand, preferably the hand opposite to the shoulder attachment mechanism 34. For example, in the drawings, the person wearing the gown would preferably use their left-hand to grip the free end 38 of the strap 30 which hangs on the front of the gown near their stomach. The person can then raise their left hand and pull the strap 30 so as to release from the attachment mechanism 34. Then, the person can move their left hand around in front of and above their head, then across to the left side, such that a central portion of the strap is pulled behind their neck, and then downwardly along their left side, and then across the front of their body, thereby pulling the right edge 24 of the back portion 14 toward the left, thereby closing the opening 15. Then, the person can grasp the loose end 44 of the second strap 40 with their right hand, pulling the straps 30 and 40 in opposite directions across the front of their torso for tying at a position centered or off centered adjacent their waist. Thus, the wearer can easily grip the loose end 38 of the strap 30 and pull the strap in a semi-circular motion, without reaching behind their back or neck, to close the opening 15 of the gown 10A-E.

It is understood that a second person is often not needed, but if needed, can assist in putting the gowns 10A-E on the first person and gripping the loose ends 38, 44 of the straps 30, 40, without reaching behind the person wearing the gown, and using a similar semi-circular motion described above for the first strap 30 to close the back of the gown.

The releasable attachment mechanism or fastener 34 prevents the long strap 30 from hanging on the ground or floor, which may be dirty or unsanitary, particularly for larger sized gowns having longer ties straps.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A medical gown to be worn by a person comprising:
- a front portion,
- opposite first and second side portions,
- a back portion having opposite left and right edges defining a vertical opening therebetween;
- the side portions residing between the front and back portions;
- each portion having top and bottom edges;
- the front and back portions being joined to define a neck opening and opposite shoulder portions;
- a first strap having a first end fixed to the back portion adjacent one of the left and right edges and a free second end;
- a releasable fastener to temporarily hold a segment of the first strap to one of the shoulder portions, with the free second end hanging downwardly along the front portion; and
- a second strap having a first end fixed to one of the side portions or to the front portion;
- whereby the free second end of the first straps is held by the person and pulled to release the first strap from the one shoulder portion and pulled to close the opening in the back portion without reaching behind the person's back.

2. The medical gown of claim 1 wherein the first and second straps are pulled in opposite directions by the person for tying together near the person's stomach.

3. The medical gown of claim 1 wherein the first end of the second strap is fixed to the side portion between the front portion and the one edge to which the first end of the first strap is fixed.

4. The medical gown of claim 1 wherein the fastener has at least one hook.

5. The medical gown of claim 1 wherein the fastener includes adhesive.

6. A gown for a person to wear, comprising:

front and back panels with a neck opening and left and right arm openings;

the back panel having a vertical opening with opposite side edges;

a first strap having opposite first and second ends, with the first end being attached to the back panel adjacent one of the edges;

a second strap attached to the front panel; and a fastener to temporarily attach a segment of the first strap adjacent the front panel whereby the second end of the first strap hangs forwardly over the person's shoulder.

7. The gown of claim 6 wherein the first and second straps are tied in front of the person to close the vertical opening in the back panel.

8. The gown of claim 6 wherein the front and back panels define left and right lateral halves, and the first and second straps each have a first end fixed to the same lateral half of the front and back panels.

9. The gown of claim 6 wherein the loose end of the first strap does not pass behind the person's back at any time when the gown is being put on.

10. The gown of claim 6 wherein the first strap is pulled around the person's neck, then downwardly, and then forwardly to close the vertical opening.

11. A method of tying a gown having a closed front and an open back, and having a strap with a fixed end attached to the gown back and a free end, the method comprising:

placing the gown on a person with the front adjacent the person's front and the back adjacent the person's back;

temporarily extending the first strap upwardly from the back so that a mid-segment of the strap goes over the person's shoulder, and then downwardly with the free end of the strap residing in front of the person;

grasping the free end with one hand, and then pulling the free end above the head toward the opposite shoulder so that the strap passes around the back of the person's neck, and then downwardly and forwardly to a position in front of the person;

grasping a free end of a second strap with the other hand and pulling to a position in front of the person; and then the straps being pulled in opposite directions to a position in front of the person so as to close the open back of the gown; and then tying the loose ends together.

12. The method of claim 11 further comprising temporarily fastening the first strap to a shoulder portion of the gown before the gown is placed on the person.

13. The method of claim 12 wherein pulling the free end of the first strap releases the first strap from the fastening at the shoulder portion.

14. The method of claim 13 further comprising moving the free end of the strap in a semi-circular motion above the person's head so that the strap passes behind the person's neck.

15. The method of claim 11 wherein the free ends of the straps are grasped by the person wearing the gown without reaching behind their back.

16. The method of claim 11 wherein the free ends of the straps are grasped by an assistant standing in front of the person and without reaching behind the person's back.

* * * * *